US006889658B2

(12) United States Patent
Winter et al.

(10) Patent No.: US 6,889,658 B2
(45) Date of Patent: May 10, 2005

(54) FUEL INJECTION DEVICE FOR AN INTERNAL COMBUSTION ENGINE

(75) Inventors: Joachim Winter, Korntal-Muenchingen (DE); Detlev Potz, deceased, late of Stuttgart (DE); by Wendelin Potz, legal representative, Stuttgart (DE); by Maike Sander-Potz, legal representative, Stuttgart (DE); Gerhard Mack, Stuttgart (DE); Christoph Buehler, Gerlingen (DE); Friedrich Moser, Ludwigsburg (DE); Thomas Kuegler, Korntal-Muenchingen (DE); Philippe Allio, Montluel (FR); Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 9 days.

(21) Appl. No.: 10/415,082

(22) PCT Filed: Aug. 23, 2002

(86) PCT No.: PCT/DE02/03139

§ 371 (c)(1),
(2), (4) Date: Oct. 20, 2003

(87) PCT Pub. No.: WO03/018990

PCT Pub. Date: Mar. 6, 2003

(65) Prior Publication Data

US 2004/0065294 A1 Apr. 8, 2004

(30) Foreign Application Priority Data

Aug. 25, 2001 (DE) ..... 101 41 678

(51) Int. Cl.[7] ..... F02M 37/04; F02M 45/08

(52) U.S. Cl. ..... 123/446; 123/500; 123/508; 239/533.12

(58) Field of Search ..... 123/446, 467, 123/470, 496, 500–501, 506–508; 239/533.2, 533.12

(56) References Cited

U.S. PATENT DOCUMENTS

| | | | | |
|---|---|---|---|---|
| 4,285,471 | A | | 8/1981 | Eblen et al. |
| 4,356,976 | A | | 11/1982 | Eblen et al. |
| 5,628,293 | A | * | 5/1997 | Gibson et al. ..... 123/446 |
| 5,899,389 | A | * | 5/1999 | Pataki et al. ..... 239/533.2 |
| 6,003,497 | A | | 12/1999 | Rodier et al. |
| 6,024,297 | A | * | 2/2000 | Greeves ..... 239/96 |
| 6,220,528 | B1 | * | 4/2001 | Cooke et al. ..... 239/533.3 |
| 6,247,450 | B1 | * | 6/2001 | Jiang ..... 123/446 |
| 6,260,775 | B1 | * | 7/2001 | Lambert et al. ..... 239/533.3 |

(Continued)

FOREIGN PATENT DOCUMENTS

DE 44 32 686 A 5/1996

*Primary Examiner*—Hai Huynh
(74) *Attorney, Agent, or Firm*—Ronald E. Greigg

(57) ABSTRACT

The fuel injection system has one high-pressure fuel pump (10) with a pump work chamber (22) and one fuel injection valve (12), communicating with the pump work chamber, for each cylinder of the engine. The fuel injection valve (12) has a first injection valve member (28), by which at least a first injection opening (32) is controlled, and which is movable in an opening direction (29) counter to a closing force by the pressure generated in the pump work chamber (22). Inside the hollow first injection valve member (28), a second injection valve member (128) is guided displaceably, by which at least a second injection opening (132) is controlled, and which is movable by the pressure prevailing in the pressure chamber (40) in an opening direction (29) counter to a closing force; the second injection valve member (128) is acted upon at least indirectly by the pressure prevailing in a fuel-filled control chamber (50), which pressure is generated, as a function of operating parameters of the engine, by a feed pump (52) such that the second injection valve member (128) either remains in its closed position, or can open.

20 Claims, 3 Drawing Sheets

Figure 1:
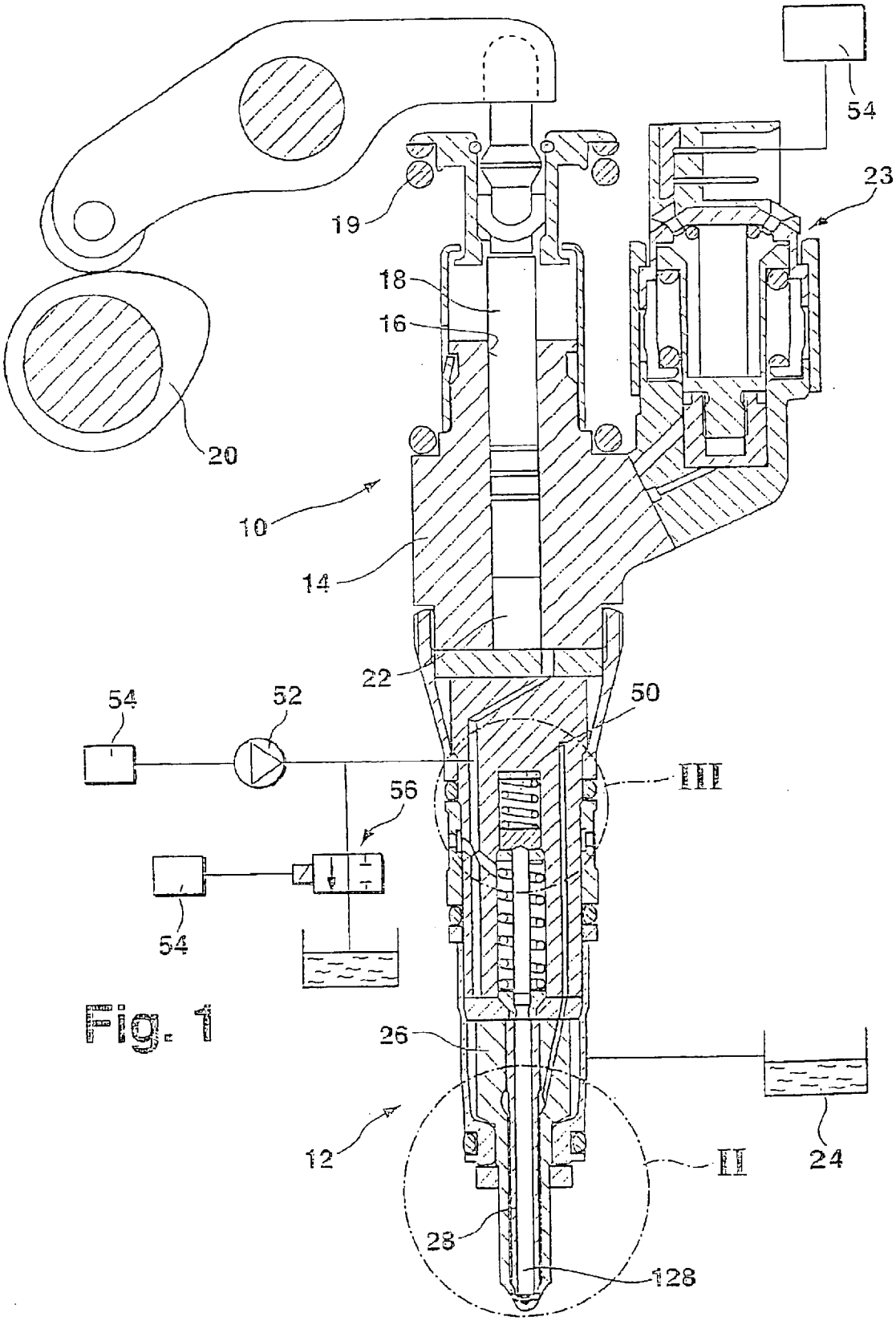

U.S. PATENT DOCUMENTS 6,279,840 B1 * 8/2001 Buckley ..... 239/533.4
6,338,445 B1 * 1/2002 Lambert et al. ..... 239/533.12
6,378,503 B1 * 4/2002 Lambert ..... 123/468
6,418,914 B1 * 7/2002 Gibson et al. ..... 123/508
6,431,469 B2 * 8/2002 Lambert et al. ..... 239/533.3
6,557,779 B2 * 5/2003 Perr et al. ..... 239/96
6,601,566 B2 * 8/2003 Gillis et al. ..... 123/468
6,684,854 B2 * 2/2004 Coldren et al. ..... 123/446
6,725,838 B2 * 4/2004 Shafer et al. ..... 123/446
2003/0172910 A1 * 9/2003 Mattes et al. ..... 123/447

* cited by examiner

FUEL INJECTION DEVICE FOR AN INTERNAL COMBUSTION ENGINE

PRIOR ART

The invention is based on a fuel injection system for an internal combustion engine as generically defined by the preamble to claim 1.

One such fuel injection system is known from European Patent Disclosure EP 0 957 261 A1. For each cylinder of the engine, this fuel injection system has one high-pressure fuel pump and one fuel injection valve communicating with it. The high-pressure fuel pump has a pump piston, which is driven in a reciprocating motion by the engine and which defines a pump work chamber that communicates with a pressure chamber of the fuel injection valve. The fuel injection valve has an injection valve member, by which at least one injection opening is controlled, and which is movable by the pressure prevailing in the pressure chamber in an opening direction counter to a closing force. By means of an electrically controlled control valve, a communication of the pump work chamber with a relief chamber is controlled in order to control the fuel injection. When the pressure in the pump work chamber and thus in the pressure chamber of the fuel injection valve reaches the opening pressure, the injection valve member moves in the opening direction and uncovers the at least one injection opening. The injection cross section that is controlled by the injection valve member in the process is always the same size. This does not enable optimal fuel injection under all engine operating conditions.

ADVANTAGES OF THE INVENTION

The fuel injection system of the invention having the characteristics of claim 1 has the advantage over the prior art that by means of the second injection valve member, an additional injection cross section can be opened or closed with the least one injection opening as a function of engine operating parameters, so that the injection cross section can be adapted optimally to engine operating conditions. Controlling the intermediate shaft is effected in a simple way by means of the pressure generated in the control chamber by the feed pump, as a function of the operating parameters.

In the dependent claims, advantageous features and refinements of the fuel injection system of the invention are disclosed. In the embodiment of claim 3, elevated pressure in the control chamber is required not for blocking the second injection valve member, which typically occurs at low load and/or low engine rpm, but rather to enable the opening motion of the second injection valve, which typically occurs at high load and/or high engine rpm, where the driving power required for the feed pump is not such a major consideration. The embodiment of claim 4 makes it possible for the opening pressure of the first injection valve member also to be varied by the pressure in the control chamber as a function of operating parameters of the engine. In the embodiment of claim 7, an elevated pressure is required for blocking the second injection valve member, which typically occurs at low load and/or low engine rpm, while at high load and/or high rpm, an elevated pressure in the control chamber is not required, so that in this case an overload on the high-pressure fuel pump and the feed pump is counteracted because only slight pressure has to be generated by the feed pump.

DRAWING

Several exemplary embodiments of the invention are shown in the drawing and described in further detail in the ensuing description.

Figure 2:
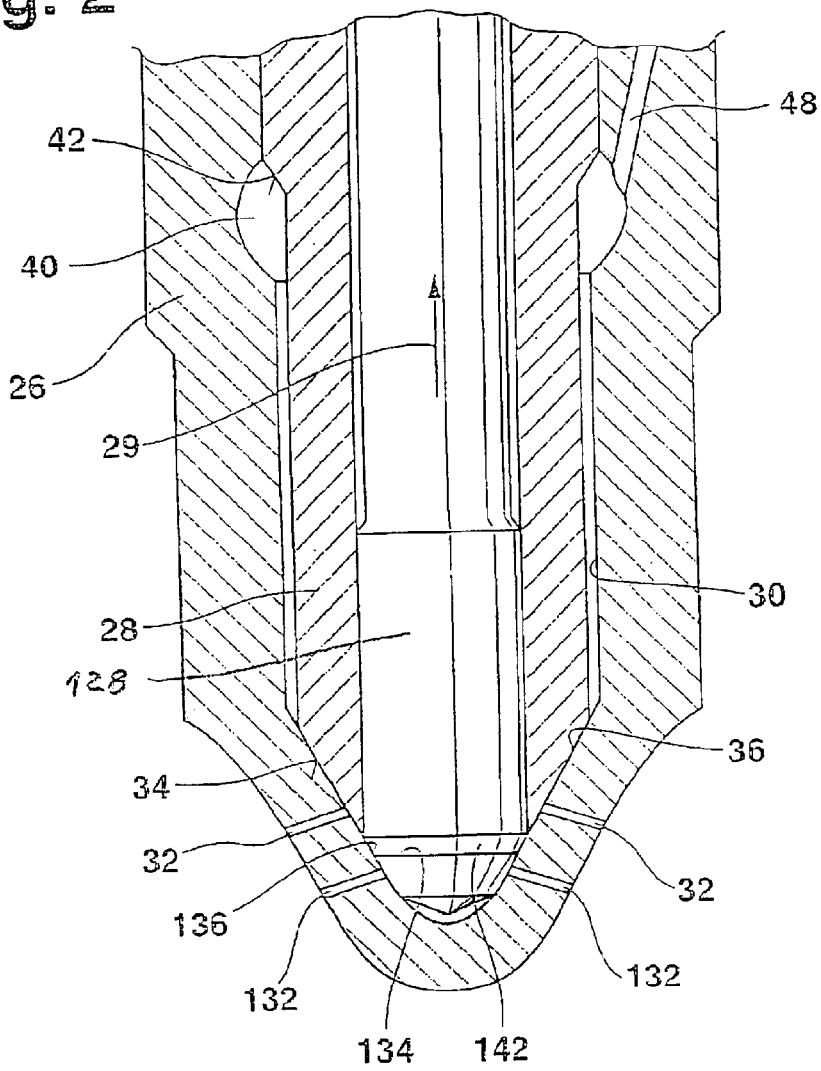
Figure 5:
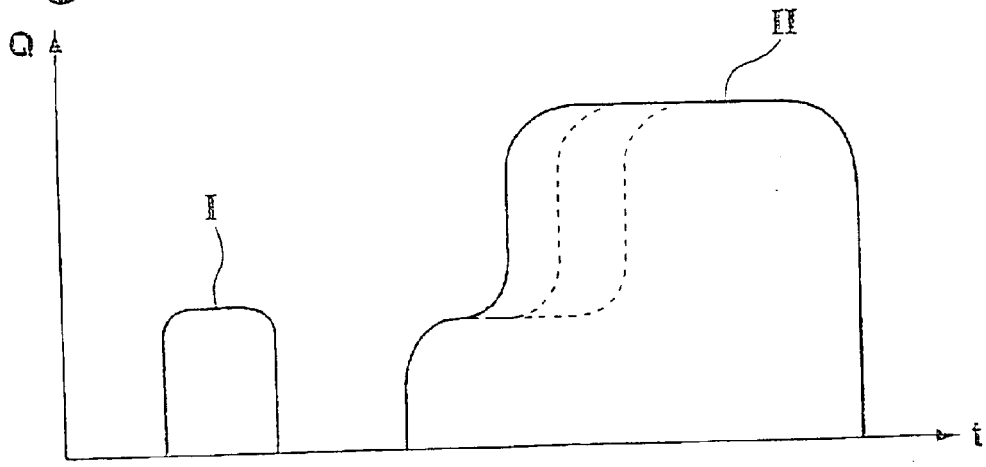
Figure 3:
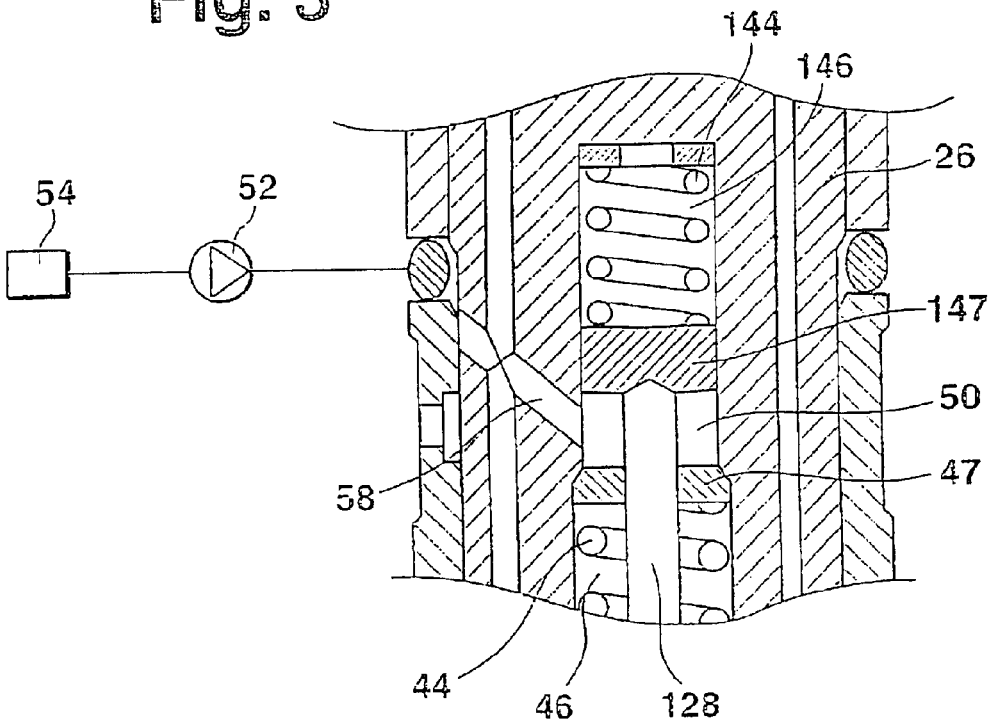
Figure 4:
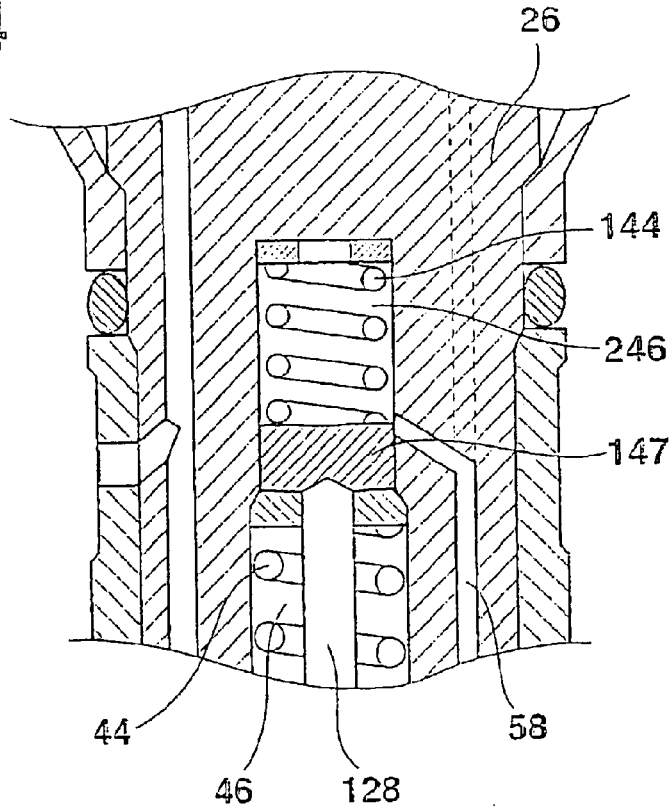

FIG. 1 shows a fuel injection system for an internal combustion engine schematically in a first exemplary embodiment;

FIG. 2, an enlarged view of a detail, marked II in FIG. 1, of the fuel injection system;

FIG. 3, an enlarged view of a detail, marked III in FIG. 1, of the fuel injection system;

FIG. 4, the detail, marked II in FIG. 1, of the fuel injection system in a second exemplary embodiment; and FIG. 5, a fuel injection quantity course of the fuel injection system, over time.

DESCRIPTION OF THE EXEMPLARY EMBODIMENTS

In FIGS. 1–4, a fuel injection system for an internal combustion engine of a motor vehicle is shown. The engine is preferably a self-igniting internal combustion engine. The fuel injection system is embodied as a so-called unit injector or pump-line-nozzle system and for each cylinder of the engine has one high-pressure fuel pump 10 and one fuel injection valve 12 communicating with it. In an embodiment as a pump-line-nozzle system, the high-pressure fuel pump 10 is disposed at a distance from the fuel injection valve 12 and communicates with it via a line. In the exemplary embodiments shown, the fuel injection system is embodied as a unit injector, in which the high-pressure fuel pump 10 and the fuel injection valve 12 communicate directly with one another and form a structural unit. The high-pressure fuel pump 10 has a pump piston 18, guided tightly in a cylinder bore 16 in a pump body 14, and this piston is driven in a reciprocating motion by a cam 20 of a camshaft of the engine, counter to the force of a restoring spring 19. In the cylinder 16, the pump piston 18 defines a pump work chamber 22, in which in the pumping stroke of the pump piston 18 fuel is compressed at high pressure. In the intake stroke of the pump piston 18, fuel from a fuel tank 24 of the motor vehicle is delivered to the pump work chamber 22 in a manner not shown in further detail.

The fuel injection valve 12 has a valve body 26, which can be embodied in multiple parts and in which a first injection valve member 28 is guided longitudinally displaceably in a bore 30. As shown in FIG. 2, the valve body 26, in its end region toward the combustion chamber of the cylinder of the engine, has at least one first injection opening, and preferably a plurality of first injection openings 32, which are distributed over the circumference of the valve body 26. The first injection valve member 28, in its end region toward the combustion chamber, has a sealing face 34, which for instance is approximately conical, and which cooperates with a valve seat 36 embodied in the end region of the valve body 26 oriented toward the combustion chamber, and from this valve seat or downstream of it, the first injection openings 32 lead away. Between the injection valve member 28 and the bore 30 in the valve body 26, toward the valve seat 36, there is an annular chamber 38, which in its end region remote from the valve seat 36 changes over, by means of a radial widening of the bore 30, into a pressure chamber 40 that surrounds the first injection valve member 28. At the level of the pressure chamber 40, as a result of a cross-sectional reduction, the first injection valve member 28 has a pressure shoulder 42. The end of the first injection valve member 28 remote from the combustion chamber is engaged by a first prestressed closing spring 44, by which the first injection valve member 28 is pressed toward the valve seat 36. The first closing spring 44 is disposed in a first spring chamber 46 of the valve body 26, which chamber adjoins the bore 30.

The first injection valve member 28 of the fuel injection valve 12 is embodied as hollow, and in it, a second injection valve member 128 is guided displaceably in a bore embodied coaxially in the injection valve member 28. By means of the second injection valve member 128, at least one second injection opening 132 in the valve body 26 is controlled. The at least one second injection opening 132 is offset toward the combustion chamber in the direction of the longitudinal axis of the injection valve members 28, 128 from the at least one first injection opening 32. The second injection valve member 128, in its end region toward the combustion chamber, has a sealing face 134, which for instance is approximately conical, and which cooperates with a valve seat 136, embodied in the valve body 126 in its end region toward the combustion chamber, from which or downstream of which valve seat the second injection openings 132 lead away. The second injection valve member 128 can be embodied in two parts and can have one part, toward the combustion chamber, that has the sealing face 134 and one second part, pointing away from the combustion chamber, that adjoins the first part. Near the end toward the combustion chamber of the second injection valve member 128, a pressure face 142 is embodied on the injection valve member, and when the first injection valve member 28 is opened, the pressure prevailing in the pressure chamber 40 acts on this pressure face.

As shown in FIGS. 1 and 3, a second spring chamber 145 is embodied in the valve body 26, adjacent to the first spring chamber 46 in the direction away from the combustion chamber, and a second closing spring 144, acting on the second injection valve member 128, is disposed in this second spring chamber. The second spring chamber 146 is embodied as somewhat smaller in diameter than the first spring chamber 46. The first injection valve member 28 protrudes with its end into the first spring chamber 46 and is braced on the first closing spring 144. The first closing spring 44 is braced with its end remote from the first injection valve member 28 on a sleeve 47. The sleeve 47 is in turn supported on an annular shoulder, form by the reduction in diameter at the transition from the first spring chamber 46 to the second spring chamber 146. The sleeve 46 can be press-fitted into the first spring chamber 46 and thus fixed, or alternatively, it can be displaceable in the first spring chamber 46 in the direction of the longitudinal axis of the first injection valve member 28. The second injection valve member 128 protrudes through the sleeve 47 into the second spring chamber 146, and it is braced on the second closing spring 144 via a spring plate 147. The second closing spring 144 is braced, by its end remote from the second valve member 128, on the bottom of the second spring chamber 146. By means of the sleeve 47 on the one hand and the spring plate 147 on the other, a control chamber 50 is defined between the first spring chamber 46 and the second spring chamber 146.

From the pump work chamber 22, a conduit 48 leads through the pump body 14 and the valve body 26 into the pressure chamber 40 of the fuel injection valve 12. By means of an electrically controlled valve 23, a communication of the pump work chamber 22 with a relief chamber is controlled; by way of example, the fuel tank 24 can serve at least indirectly as this relief chamber, or a region in which a pressure that is somewhat elevated compared to the fuel tank 24 is maintained can serve as the relief chamber. As long as no fuel injection is to occur, the control valve 23 triggered by an electronic control unit 54 is intended to keep the communication of the pump work chamber 22 with the relief chamber open, so that high pressure cannot build up in the pump work chamber 22. When a fuel injection is to occur, the pump work chamber 22 is disconnected from the relief chamber by the control valve 23, so that upon the pumping stroke of the pump piston 18, high pressure can build up in the pump work chamber 22. The control valve 23 can be embodied as a magnet valve or as a piezoelectric valve.

The fuel injection system is shown in a first exemplary embodiment in FIGS. 1–3. The control chamber 50 communicates with a pressure source, for instance in the form of a feed pump 52, which aspirates fuel from the fuel tank 24. The feed pressure generated by the feed pump 52 is controlled as a function of engine operating parameters, such as load, rpm, and temperature in particular, and optionally still other parameters. It can be provided that the operation of the feed pump 52, and in particular its rpm, is controlled as a function of the operating parameters by a control unit 54. It is also possible to provide a pressure limiting valve 56 in the communication between the control chamber 50 and the feed pump 52, which valve is triggered by the control unit 54 and limits the feed pressure, generated by the feed pump 52, to a predetermined value. In the valve body 26, a conduit 58 discharging into the control chamber 50 is embodied, and by way of it the control chamber 50 communicates with the feed pump 52. It can be provided that the conduit 58 extends on as far as the control valve 23, and that by means of the feed pump 52, via the conduit 58, fuel is also delivered into the pump work chamber 22 in the intake stroke of the pump piston 18 and with the control valve 23 open. The conduit 58 and the compression side of the feed pump 52 also serve here as a relief chamber, with which the pump work chamber 22 can be made by the control valve 23 to communicate, for controlling the fuel injection. Preferably, for the fuel injection systems of all the cylinders of the engine, only a single feed pump 52 is provided.

By means of the second closing spring 144, the second injection valve member 128 is pressed with its sealing face 134 against the second valve seat 136 in the valve body 26. A force on the second injection valve member 128 counteracting the force of the closing spring 144 is generated by means of the pressure prevailing in the control chamber 50, via the spring plate 147. The second closing spring 144 has strong prestressing, so that even at high pressure in the pressure chamber 40 of the fuel injection valve 12, it can keep the second on valve member 128 in its closed position when the pressure in the control chamber 50 is low, and the second injection valve member 128 can open only when an elevated pressure prevails in the control chamber 50. If the sleeve 47 is fixed in the first spring chamber 46, then the pressure prevailing in the control chamber 50 is not exerted on the first injection valve member 28. However, if the sleeve 47 is displaceable, then with increasing pressure in the control chamber 50, via the then-displaced sleeve 47 which forms a brace for the first closing spring 44, the prestressing of the first closing spring 44 is increased, and thus the opening pressure of the first injection valve member 28 is increased.

The function of the fuel injection system in the first exemplary embodiment will now be explained. Upon the intake stroke of the pump piston 18, the control valve 23 is opened, so that fuel from the fuel tank 24 reaches the pump work chamber 22. In the pumping stroke of the pump piston 18, the onset of the fuel injection is defined as a result of the fact that the control valve 23 closes, so that the pump work chamber 22 is disconnected from the relief chamber, and high pressure builds up in the pump work chamber 22. As a function of engine operating parameters, the pressure generated by the feed pump 52 and prevailing in the control chamber 50 is adjusted. When a low pressure in the control chamber 50 is generated by the feed pump 52, the second injection valve member 128 is pressed with high force with its sealing face 134 against the valve seat 136 by the second closing spring 144. If the pressure in the pump work chamber 22 and thus in the pressure chamber 40 of the fuel injection valve 12 is so high that the pressure force generated by it on the first injection valve member 28 via the pressure shoulder 42 is greater than the force of the first closing spring 44, then the fuel injection valve 12 opens, because the first injection valve member 28 lifts with its sealing face 34 from the valve seat 36 and uncovers the at least one first injection opening 32. The closing force exerted by the second closing spring 144 on the second injection valve member 128 is greater than the force exerted, by the pressure prevailing in the pressure chamber 40, on the second injection valve member 128 via the pressure face 142, so that the second injection valve member 128 remains in its closed position. Thus with the first injection openings 32, only a portion of the total injection cross section is opened at the fuel injection valve 12, so that correspondingly only a slight fuel quantity is injected.

When the second injection valve member 128 is supposed to open as well, then by the feed pump 52, an elevated pressure in the control chamber 50 is generated, which via the spring plate 147 acts on the second injection valve member 128 and reinforces the force in the opening direction 29 that is generated on the second injection valve member 128 via the pressure face 142 by the pressure prevailing in the pressure chamber 40. Once the pressure in the control chamber 50, which is generated by the feed pump 52, and the pressure in the pressure chamber 40, which is generated by the pump piston 18, are high enough, then in addition to the first injection valve member 28 the second injection valve member 128 also opens and uncovers the second injection openings 132. Thus the total injection cross section of the fuel injection valve 12 is uncovered, and a larger fuel quantity is injected. The end of the fuel injection is determined by the opening of the control valve 23, by which the pump work chamber 22 is made to communicate with the relief chamber, so that high pressure can no longer build up in it.

It can be provided that the injection cross sections formed by the first injection openings 32 and the second injection openings 132 are at least of approximately equal size, so that when only the first injection valve member 28 is opened, half of the total injection cross section is uncovered. Alternatively, it can be provided that the first injection openings 32 form a larger or smaller injection cross section than the second injection openings 132.

In FIG. 5, the course of the fuel injection quantity Q is shown over the time t during one injection cycle. It can be provided that at the onset of the fuel injection, a low pressure is established in the control chamber 50, so that at a slight pumping stroke of the pump piston 18, initially only the first injection valve member 28 opens, and only a portion of the total injection cross section at the fuel injection valve 12 is uncovered. A preinjection of a slight fuel quantity then takes place through only the first injection openings 32; this is indicated in FIG. 5 as an injection phase I. With an increasing pumping stroke of the pump piston 18, an elevated pressure can be established in the control chamber 50, so that the second injection valve member 128 opens in addition, and the total injection cross section at the fuel injection valve 12 is uncovered. A main injection of a large fuel quantity then takes place through the first injection openings 32 and the second injection openings 132; this is designated as an injection phase II in FIG. 5. Alternatively or in addition, it can be provided that at the onset of a fuel injection, the pressure in the control chamber 50 is established such that only the first injection valve member 28 opens and uncovers the at least one first injection opening 32, and that only later during the main fuel injection is the pressure in the control chamber 50 established such that the second injection valve member 128 also opens and uncovers the at least one second injection opening 132. As a result, as shown in FIG. 5 for injection phase II, a graduated main fuel injection is attained, in which at the onset, a slight fuel quantity per unit of time is injected through the first injection openings 32, and only later during the main fuel injection is a large fuel quantity per unit of time injected through the first and second injection openings 32, 132. The instant at which the second injection openings 132 are uncovered is determined by the pressure in the control chamber 50. In FIG. 5, dashed lines indicate the possible influence of the pressure in the control chamber 50 on the increase in the fuel injection quantity. Independently of the pressure in the control chamber 50, the second closing spring 144 acting on the second injection valve member 128 causes the second injection valve member 128 to open only somewhat later than the first injection valve member 28, as shown in FIG. 5 with a solid line for injection phase II, but the instant of opening of the second injection valve member 128 can be varied by the pressure prevailing in the control chamber 50. It can also be provided that at certain engine operating parameters, and especially at low load and/or low rpm, when only a slight fuel quantity is injected, only the first injection valve member 28 opens over the entire pumping stroke of the pump piston 18, while the second injection valve member 128 remains closed.

If the sleeve 47 is displaceable in the first spring chamber 46, then with increasing pressure in the control chamber 50, the closing force acting on the first injection valve member 28 increases. If the pressure in the control chamber 50, as indicated above, is increased with an increasing pumping stroke of the pump piston 18 and increasing engine load and/or increasing rpm, then the opening pressure of the first injection valve member 28, that is, the pressure in the pressure chamber 40 at which the first injection valve member 28 opens, also increases. Thus without additional effort or expense, a variation in the opening pressure of the first injection valve member 28 as a function of operating parameters of the engine is also made possible.

In FIG. 4, the fuel injection system is shown in a detail of the second exemplary embodiment, in which the fundamental layout is the same as in the first exemplary embodiment. In a departure from the first exemplary embodiment, however, in the second exemplary embodiment the disposition of the control chamber is modified. Here the control chamber is formed by the second spring chamber 246, and is defined by the spring plate 147, embodied as a piston, of the second injection valve member 128. The sleeve 47 is fixed in the first spring chamber 46 and is not acted upon by the pressure prevailing in the control chamber 246. The pressure prevailing in the control chamber 246 acts on the second injection valve member 128 via the spring plate 147 and reinforces the force of the second closing spring 144. The conduit 58 that communicates with the feed pump 52 and that is embodied in the valve body 26 discharges into the control chamber 246. If a slight pressure prevails in the control chamber 246, then a slight closing force, generated essentially by the prestressing of the second closing spring 144, acts on the second injection valve member 128. If an elevated pressure prevails in the control chamber 246, then an elevated closing force acts on the second injection valve member 128.

The function of the fuel injection system in the second exemplary embodiment is essentially the same as in the first exemplary embodiment, except that as a function of engine operating parameters, especially at low load and/or low rpm, an elevated pressure is established in the control chamber 246 by the feed pump 52, if only the first injection valve member 28 is to open and the second injection valve member 128 is to remain closed, and only a portion of the entire injection cross section is to be uncovered. Correspondingly, as a function of engine operating parameters, especially at high load and/or high rpm, a low pressure in the control chamber 246 is established by the feed pump 52 if the first injection valve member 28 and the second injection valve member 128 are supposed to open, and the entire injection cross section is supposed to be uncovered.

What is claim is:

1. In a fuel injection system for an internal combustion engine, having one high-pressure fuel pump (10) and one fuel injection valve (12), communicating with it, for each cylinder of the engine, in which the high-pressure fuel pump (10) has a pump piston (18), driven in a reciprocating motion by the engine, which piston defines a pump work chamber (22) that communicates with a pressure chamber (40) of the fuel injection valve (12), and the fuel injection valve (12) has at least one first injection valve member (28), by which at least one first injection opening (32) is controlled and which is movable in an opening direction (29), counter to a closing force, by the pressure prevailing in the pressure chamber (40), and having a first electrically controlled control valve (23), by which a communication of the pump work chamber (22) with a relief chamber is controlled, the fuel injection valve (12) has a second injection valve member (128), guided displaceably inside the hollow first injection valve member (28), by means of which second injection valve member at least one second injection opening (132) is controlled, and which second injection valve member is movable in an opening direction (29) counter to a closing force by the pressure prevailing in the pressure chamber; and wherein the second injection valve member (128) is acted upon at least indirectly by the pressure prevailing in a fuel-filled control chamber (50; 246), which pressure is generated by a pressure source (52) as a function of operating parameters of the engine, as a result of which the opening pressure of at least the second injection valve member (128) is variable.

2. The fuel injection system of claim 1, wherein a common pressure source (52) is provided for all the cylinders of the engine.

3. The fuel injection system of claim 2, wherein the second injection valve member (128) is acted upon by the pressure prevailing in the control chamber (50), at least indirectly counteracting the closing force, so that with increasing pressure in the control chamber (50), the closing force acting on the second injection valve member (128) is reduced.

4. The fuel injection system of claim 3, further comprising a first closing spring (44) generating the closing force on the first injection valve member (28); and wherein the first injection valve member (28), or a brace (47) of its first closing spring (44) is acted upon at least indirectly by the pressure in the control chamber (50), reinforcing the closing spring (44), so that with increasing pressure in the control chamber (50), the closing force acting on the first injection valve member (28) is increased.

5. The fuel injection system of one of claim 4, wherein at low load and/or low engine rpm, by means of the pressure source (52), a slight pressure in the control chamber (50) is generated such that the second injection valve member (128) remains in a closed position, and only the first injection valve member (28) opens and uncovers the at least one first injection opening (32); and that at a high load and/or high engine rpm, by means of the pressure source (52), a high pressure in the control chamber (50) is generated such that so that in addition the second injection valve member (128) also opens and uncovers the at least one second injection opening (132).

6. The fuel injection system of claim 3, further comprising a second closing spring (144) generating the closing force on the second injection valve member (128), the second injection valve member (128) being braced on the second closing spring (144) via a piston (147), which with its face end remote from the second closing spring (144) defines the control chamber (50).

7. The fuel injection system of one of claim 3, wherein at low load and/or low engine rpm, by means of the pressure source (52), a slight pressure in the control chamber (50) is generated such that the second injection valve member (128) remains in a closed position, and only the first injection valve member (28) opens and uncovers the at least one first injection opening (32); and that at a high load and/or high engine rpm, by means of the pressure source (52), a high pressure in the control chamber (50) is generated such that so that in addition the second injection valve member (128) also opens and uncovers the at least one second injection opening (132).

8. The fuel injection system of claim 2, wherein the second injection valve member (128) is acted upon by the pressure prevailing in the control chamber (246), at least indirectly reinforcing the closing force in the closing direction, so that with increasing pressure in the control chamber (246), the closing force acting on the second injection valve member (128) is increased.

9. The fuel injection system of claim 8, wherein at low load and/or low engine rpm, by means of the pressure source (52), a high pressure in the control chamber (246) is generated such that the second injection valve member (128) remains in its closed position, and only the first injection valve member (28) opens and uncovers the at least one first injection opening (32), and wherein at high load and/or high engine rpm, by means of the pressure source (52), a slight pressure in the control chamber (246) is generated such that in addition the second injection valve member (128) also opens and uncovers the at least one second injection opening.

10. The fuel injection system of claim 1, wherein the second injection valve member (128) is acted upon by the pressure prevailing in the control chamber (50), at least indirectly counteracting the closing force, so that with increasing pressure in the control chamber (50), the closing force acting on the second injection valve member (128) is reduced.

11. The fuel injection system of claim 10, further comprising a first closing spring (44) generating the closing force on the first injection valve member (28); and wherein the first injection valve member (28), or a brace (47) of its first closing spring (44) is acted upon at least indirectly by the pressure in the control chamber (50), reinforcing the closing spring (44), so that with increasing pressure in the control chamber (50), the closing force acting on the first injection valve member (28) is increased.

12. The fuel injection system of claim 11, further comprising a second closing spring (144) generating the closing force on the second injection valve member (128), the second injection valve member (128) being braced on the second closing spring (144) via a piston (147), which with its face end remote from the second closing spring (144) defines the control chamber (50).

13. The fuel injection system of one of claim 11, wherein at low load and/or low engine rpm, by means of the pressure source (52), a slight pressure in the control chamber (50) is generated such that the second injection valve member (128) remains in a closed position, and only the first injection valve member (28) opens and uncovers the at least one first injection opening (32); and that at a high load and/or high engine rpm, by means of the pressure source (52), a high pressure in the control chamber (50) is generated such that so that in addition the second injection valve member (128) also opens and uncovers the at least one second injection opening (132).

14. The fuel injection system of claim 10, further comprising a second closing spring (144) generating the closing force on the second injection valve member (128), the second injection valve member (128) being braced on the second closing spring (144) via a piston (147), which with its face end remote from the second closing spring (144) defines the control chamber (50).

15. The fuel injection system of claim 14, wherein at low load and/or low engine rpm, by means of the pressure source (52), a slight pressure in the control chamber (50) is generated such that the second injection valve member (128) remains in a closed position, and only the first injection valve member (28) opens and uncovers the at least one first injection opening (32); and that at a high load and/or high engine rpm, by means of the pressure source (52), a high pressure in the control chamber (50) is generated such that so that in addition the second injection valve member (128) also opens and uncovers the at least one second injection opening (132).

16. The fuel injection system of one of claim 10, wherein at low load and/or low engine rpm, by means of the pressure source (52), a slight pressure in the control chamber (50) is generated such that the second injection valve member (128) remains in a closed position, and only the first injection valve member (28) opens and uncovers the at least one first injection opening (32); and that at a high load and/or high engine rpm, by means of the pressure source (52), a high pressure in the control chamber (50) is generated such that so that in addition the second injection valve member (128) also opens and uncovers the at least one second injection opening (132).

17. The fuel injection system of claim 1, wherein the second injection valve member (128) is acted upon by the pressure prevailing in the control chamber (246), at least indirectly reinforcing the closing force in the closing direction, so that with increasing pressure in the control chamber (246), the closing force acting on the second injection valve member (128) is increased.

18. The fuel injection system of claim 17, wherein at low load and/or low engine rpm, by means of the pressure source (52), a high pressure in the control chamber (246) is generated such that the second injection valve member (128) remains in its closed position, and only the first injection valve member (28) opens and uncovers the at least one first injection opening (32), and wherein at high load and/or high engine rpm, by means of the pressure source (52), a slight pressure in the control chamber (246) is generated such that in addition the second injection valve member (128) also opens and uncovers the at least one second injection opening.

19. The fuel injection system of claim 1, wherein by means of the pressure source (52), at a slight pumping stroke of the pump piston (18) for a fuel preinjection, a pressure in the control chamber (50; 246) is generated such that the second injection valve member (128) remains in its closed position, and only the first injection valve member (28) opens and uncovers the at least one first injection opening (32); and wherein by means of the pressure source (52), with an increasing supply stroke of the pump piston (18) for a main fuel injection, a pressure in the control chamber (246) is generated such that in addition the second injection valve member (128) also opens and uncovers the at least one second injection opening (132).

20. The fuel injection system of claim 11, wherein by means of the pressure source (52), at the onset of a main fuel injection, a pressure in the control chamber (50; 246) is generated such that the second injection valve member (128) remains in its closed position and only the first injection valve member (28) opens and uncovers the at least one first injection opening (32); and wherein in the further course of the main fuel injection, by means of the pressure source (52), a pressure in the control chamber (50; 246) is generated such that in addition the second injection valve member (128) also opens and uncovers the at least one second injection opening (132).

* * * * *